United States Patent [19]

Sypula et al.

[11] Patent Number: 4,952,293

[45] Date of Patent: Aug. 28, 1990

[54] POLYMER ELECTRODEPOSITION PROCESS

[75] Inventors: Donald Sypula; Joseph Mammino, both of Penfield, N.Y.

[73] Assignee: Xerox Corporation, Stamford, Conn.

[21] Appl. No.: 459,240

[22] Filed: Dec. 29, 1989

[51] Int. Cl.[5] ..... C25D 13/06; C25D 13/14

[52] U.S. Cl. ..... 204/180.7; 204/180.9; 204/181.1; 264/24

[58] Field of Search ..... 204/180.2, 180.7, 180.9, 204/181.1; 264/24

[56] References Cited

U.S. PATENT DOCUMENTS

| | | | |
|---|---|---|---|
| 1,747,992 | 5/1988 | Sypula et al. | 264/130 |
| 3,635,809 | 1/1972 | Seki et al. | 204/181.6 |
| 4,163,703 | 8/1979 | Germez | 204/180.7 |
| 4,210,507 | 7/1980 | Davidson et al. | 204/180.7 |
| 4,440,612 | 4/1984 | Valko | 204/181.7 |
| 4,525,260 | 6/1985 | Abbey et al. | 264/181.7 |
| 4,772,253 | 9/1988 | Koizumi et al. | 474/266 |

FOREIGN PATENT DOCUMENTS 2006895 4/1968 France .

*Primary Examiner*—John F. Niebling
*Assistant Examiner*—Ben C. Hsing
*Attorney, Agent, or Firm*—Peter H. Kondo

[57] ABSTRACT

A process for preparing free standing polymeric belts which includes the steps of providing at least one sleeve electrode coaxially spaced apart from and surrounding at least one other electrode in a bath comprising a dispersion of electrically charged, thermoplastic film forming polymer particles in an organic liquid dispersion medium, the polymer particles having a weight average molecular weight of at least about 35,000 and being substantially insoluble in the organic liquid medium at electrodeposition temperatures and sufficiently soluble in the organic liquid medium at elevated temperatures to coalesce and form a viscous sol coating, applying an electric field across the electrodes until a thick, substantially uniform deposit of polymer particles forms on the interior surface of the sleeve electrode, removing the sleeve electrode bearing the deposit of polymer particles and residual liquid dispersion medium clinging to the deposit of polymer particles from the bath, heating the deposit to initially solubilize the polymer particles in the residual organic liquid dispersion medium to form a coalesced, continuous viscous sol coating of the solubilized polymer particles, continuing the heating to evaporate the residual organic liquid dispersion medium and form a continuous, solidified, cylindrical, dry polymer film, and removing the dry polymer film from the interior surface of the sleeve electrode. This dry polymer film may subsequently be coated with various layers.

20 Claims, No Drawings

POLYMER ELECTRODEPOSITION PROCESS

BACKGROUND OF THE INVENTION

This invention relates to a process for preparing free standing polymeric belts and more particularly, to a method of forming a free standing polymeric belt from a dispersion of thermoplastic film forming polymer particles in an organic liquid using an electrodeposition step.

Polymer coatings of thicknesses which are less than about 51 micrometers (2 mils) are typically used in the metal finishing industry to protect the metals from corroding and to give them a decorative appearance. Coatings of thicknesses greater than about 51 micrometers are more difficult to obtain and have application in special areas such as insulating coatings in electrical applications such as dielectric receivers and also for free standing films, such as seamless belts. These thick coatings are more difficult to obtain by conventional processes such as spray or dip coating. These conventional processes require repeated applications of thin coatings to obtain thick films. Other limitations of the spray coating process are high equipment cost for air handling, spray equipment and solvent recovery. Also, this process requires extensive factory space for equipment and processing. For polymer film belts, elaborate handling procedures and machinery are also needed to form and remove the belts after the belt is formed. Thus, fabrication techniques such as spray and dip coating systems encounter sagging, multiple application steps, long curing times, sizable equipment space requirements, high cost and other associated problems.

Most belts normally have a thickness greater than about 254 micrometers (10 mils) and are usually formed by molding or lamination. Molding is carried out in complex and expensive molds. Molded articles contain flashings that require removal to achieve a smooth outer surface. Laminated belts are usually prepared by applying alternate layers of thermoplastic sheets and reinforcing fabrics. These materials are relatively thick and stiff, and not suitable for extended cycling over small diameter pulleys or rolls. Other types of belts have been prepared by welding opposite ends of sheets together to form belts having an undesirable seam which projects above the surface of the belt.

Originally, photoreceptors for electrophotographic imaging systems comprised selenium alloys vacuum deposited on rigid aluminum substrates. These photoreceptors required elaborate, highly sophisticated, and expensive equipment for fabrication. Photoreceptors have also been prepared by coating rigid substrates with photoconductive particles dispersed in an organic film forming binder. Coating of rigid drum substrates have been effected by various techniques such as spraying, dip coating, vacuum evaporation, and the like. Rigid drum photoreceptors limit copier and printer design flexibility, are less desirable for flash exposure and are expensive. Flexible organic photoreceptors in the form of belts have recently become popular. These flexible photoreceptors are manufactured by coating a web and thereafter shearing the web into segments which are then formed into belts by welding opposite ends of the sheared web. The resulting welded seam on the photoreceptor disrupts the continuity of the outer surface of the photoreceptor and must be indexed so that it does not print out during an imaging cycle. In other words, efficient stream feeding of paper and throughput are adversely affected because of the necessity to detect a seam within the length of each sheet of paper. Seam detection is a particularly vexing problem for smaller copier and printer designs. The mechanical and optical devices required for indexing add to the complexity and cost of copiers, duplicators and printers, and reduce the flexiblity of design. Welded belts are also less desirable for electrophotographic imaging systems because the seam forms a weak point in the belt and collects toner debris during cleaning, particularly with wiper blade cleaning devices. The seam and wiper blade interaction also causes a disruption in motion quality which impacts registration and timing in applications where multiple images must be closely referred to each other.

Electrodeposition of polymer films from polymer emulsions is known in the industry and is used for applying polyamide-imide and other similar coatings on hard to coat objects such as wire windings of motors and transformers. The polymer emulsions used in this type of process are rather dilute, resulting in slow deposition rates which limit practical film thicknesses to about 76 micrometers (3 mils) or so. Also, these polymers adhere very well to metal surfaces and are not readily removable from metal surfaces to obtain a free standing film. Curing of these coatings is a problem because they contain low boiling solvents which must be slowly removed to prevent bubbling of the coating. This requires special programmed ovens and slow drying conditions. Also, replenishment of the depleted polymer portion of coating emulsions is diffult. Moreover, the number of coated articles per batch of dispersion material is limited. Further, the reclaiming of solvent for the emulsions is complex and expensive. In addition, the total cost per coated article is high.

INFORMATION DISCLOSURE STATEMENT

Japanese Patent Publication J6 1273919-A assigned to Mitsubishi Chemical Industries KK, published Dec. 4, 1986—After a resin intermediate solution is coated on a surface of a seamless metallic foil belt held in cylindrical mandrel, the solution is dried and cured to form a resin film, and the resin film is peeled from the metallic foil belt to manufacture a seamless resin belt. In this method, a mold release agent layer is previously formed or a mold release agent is contained in the resin or the resin intermediate solution. This technique may be used to form seamless resin belts used as base material for sensitizing material for duplication by forming a conductive layer such as aluminum on a resin surface if the resin is a heat resistant rin, e.g., polyamide.

U.S. Pat. No. 3,635,809 to Seki et al, issued Jan. 18, 1972—An electrodeposition process is disclosed comprising electrophoretically depositing a polyvinylidene fluoride resin on an electrical conductor from a solvent mixture of a vinylidene fluoride resin powder dispersion in an organic liquid dispersion medium, the organic liquid having a dielectric constant greater than about 3.8 and being selected from organic liquids having a solubility parameter of from about 7 to 13, exhibiting a low degree of hydrogen bonding, a solubility parameter of from about 7.7 to 12.5 exhibiting a middle degree of hydrogen bonding a solubility parameter of from about 9.6 to 11.8 exhibiting a high degree of hydrogen bonding.

J.J. Dietrich et al, Polyvinyl Fluoride, Paint and Varnish Production, 75, Nov., 1966—Polyvinyl fluoride (PVF) dispersion coatings applied to substrates are disclosed. Latent solvents that become active at elevated temperatures and exert a solvating action on PVF at elevated temperatures are also described. The use of latent solvents and elevated temperatures processing allows discrete PVF resin particles to coalesce into a continuous phase and form a coating on a substrate.

U.S. Pat. No. 4,525,260 to Abbey, issued Jun. 25, 1985—A cathodic electrocoating composition is described comprising an aqueous suspension of synthetic, cation-active, film forming latex particles characterized by a latex gel content that is not substantially above about 10 percent. Numerous monomer types useful for forming suitable latices are listed in this patent. The wet deposit may be cured to its final dried and hardened state generally by baking the coated article at about 120° C. to 230° C. for 5 to 30 minutes, or by radiation curing. The latex forms on a cathode. Little or no solvent is preferred because the presence of solvent such as alkoxyalkanols, hydrocarbons such as naphtha or toluence, or an acetate such butyl acetate tends to lower the rupture voltage of the electrodeposited latex film.

U.S. Pat. No. 4,747,992 to Sypula et al, issued May 31, 1988—A process is disclosed for forming at least one thin substantially uniform coating comprising polymeric film forming material on a cylindrical mandrel, solidifying the fluid coating to form solid coating and separating the uniform solid coating from the mandrel.

U.S. Pat. No. 4,772,253 to Koizumi et al, issued Sept. 20, 1988 and GB 2,189,192 published Oct. 21, 1987—A seamless belt is disclosed comprising a layer of metal 10 to 50 micrometers thick and a lining layer made of a flexible material such a synthetic resin or rubber provided on the inside surface thereof. The belt is used as a substrate for a photosensitive belt for an electrostatic photographic copying machine. The lining may be prepared by coating, bonding, adhesion, or other methods. The edge of the belt may have a shift limiting means which project inwardly at both ends of the belt to limit shift of the belt.

U.S. Pat. No. 4,440,612 to Velko, issued Apr. 3, 1984—A coating composition is disclosed comprising a polymeric polyol with a polyester cross-linking agent. The coating composition may be used to form aqueous-based coating compositions which may be used in coating applications such as electrodeposition and for organic solvent-based coatings without cationic salt groups. After the coating has been applied, it is cured by heating at elevated temperatures such as about 150° C. to about 205° C. for about 10 to 45 minutes to form solvent resistant coatings.

French Patent Document 2,006,895 assigned to Chemische Werke Albert, published Apr. 25, 1968—An aqueous suspension is disclosed comprising synthetic resins as the electrophoresis medium. The resins are condensation resins such as phenolic, polyester or polyamide resin. The process is carried out at a temperature of ambient to 50° C. but always 10° C. to 20° C. below the melting point of the resin. The aqueous suspension also contains dispersant emulsifier additives and additional pigments can be used. Coatings greater than 100 micrometers are obtained in which currents of 0.1 to 30 $mA/cm^2$ are used for coating metallic objects.

U.S. Pat. No. 4,210,507 to Davidson et al, issued Jul. 1, 1980—A hollow electrically conductive probe is provided for electrocoating a metal container such as food cans.

U.S. Pat. No. 4,163,703 to Germez, issued Aug. 7, 1979—A method is disclosed for applying enamel by electrophoresis inside a hollow body such as a sheet metal part. For enamel deposition by electrophoresis, an electric current is used to convey particles of enamel in an enamel slip (e.g. in suspension in water) from a cathode to the surface to be covered which acts as an anode.

While some of the above described materials may still be useful, there continues to be a need for improved, flexible, free standing polymeric films, and more particularly, electrodeposited seamless belts for various applications including electrostatographic imaging members.

SUMMARY OF THE INVENTION

It is a feature of the present invention to provide a process for fabricating improved flexible, free standing, electrodeposited polymeric belts which overcome the above noted disadvantages.

It is still another feature of the present invention to provide a process for fabricating improved flexible, free standing, electrodeposited polymeric belts which avoid sagging during deposition.

It is still another feature of the present invention to provide a process for fabricating improved flexible, free standing, electrodeposited polymeric belts which elminates the need for multiple application of polymer material to achive a thick film.

It is still another feature of the present invention to provide a process for fabricating improved flexible, free standing, electrodeposited polyeric belts which reduces film curing time.

It is still another feature of the present invention to provide a process for fabricating improved flexible, free standing, electrodeposited polymeric belts which avoids the need for extensive processing and equipment space.

It is still another feature of the present invention to provide a process for fabricating improved flexible, free standing, electrodeposited polymeric belts which minimizes equipment complexity and cost.

It is still another feature of the present invention to provide a process for fabricating an improved flexible, electrodeposited belt which is free of seams.

It is still another feature of this invention to provide a process for fabricating a flexible, electrodeposited seamless belt which readily forms a thin uniform coating on a mandrel.

It is still another feature of this invention to provide a process for fabricating a flexible, solid, electrodeposited seamless belt which is readily removed from an electrode.

It is still another feature of this invention to provide a process for fabricating a flexible, electrodeposited seamless belt which eliminates the need for seam detection devices.

It is still another feature of this invention to provide a process for fabricating a flexible, electrodeposited seamless belt which allows greater throughput of documents in imaging systems for higher productivity.

These and other features of the present invention are accomplished by providing at least one sleeve electrode coaxially spaced apart from and surrounding at least one other electrode in a bath comprising a dispersion of electrically charged, thermoplastic film forming polymer particles in an organic liquid dispersion medium, the polymer particles having a weight average molecular weight of at least about 35,000 and being substantially insoluble in the organic liquid medium at electrodeposition temperatures and sufficiently soluble in the organic liquid medium at elevated temperatures to coalesce and form a viscous sol coating, applying an electric field across the electrodes until a thick, substantially uniform deposit of polymer particles forms on the interior surface of the sleeve electrode, removing the sleeve electrode bearing the deposit of polymer particles and residual liquid dispersion medium clinging to the deposit of polymer particles from the bath, heating the deposit to initially solubilize the polymer particles in the residual organic liquid dispersion medium to form a coalesced, continuous viscous sol coating of the solubilized polymer particles, continuing the heating to evaporate the residual organic liquid dispersion medium and form a continuous, solidified, cylindrical, dry polymer film, and removing the dry polymer film from the interior surface of the sleeve electrode. This dry polymer film may subsequently be coated with various layers.

Any suitable high molecular weight polar or nonpolar thermoplastic film forming polymer may be employed in the process of this invention. Typical nonpolar thermoplastic film forming polymers include chloro, bromo or fluoro substituted polyvinyl compounds such as polyvinyl fluoride, (e.g., Tedlar available from E.I. du Pont de Nemours & Co.) polyvinylidene fluoride (e.g. Kynar 202 available from Pennwalt Corp.), and polyvinyl chloride; polyethylene; polypropylene; polyethers, styrene-butadiene copolymers, polybutylenes, and the like. Typical polar thermoplastic film forming polymers include polyamides (e.g. nylon); polycarbonates (e.g. Makrolon 5705, available from Bayer Chemical Co., Merlon M39, available from Mobay Chemical Co., Lexan 145, available from General Electric Co.); polyesters (e.g. PE-100 and PE-200, available from Goodyear Tire and Rubber Co.), polysulfones (e.g. P-3500, available from Union Carbide Corp.), polysulfides, cellulosic resins, polyarylates acrylics, polyarylsulfones, polyphenylenesulfides, polyurethanes, polyimides, epoxies, poly(amide-imide) (e.g. Torlon Polymer A1830, available from AMOCO Chemical Corp.), copolyesters (Kodar Copolyester PETG 6763 available from Eastman Kodak Co.) polyethersulfones, polyetherimide (e.g. Ultem available from General Electric Co.), polyarylethers, and the like. Polycarbonate polymers may be made, for example, from 2.2-bis(4-hydroxyphenol)propane, 4,4'-dihydroxy-diphenyl-1,1-ethane, 4,4'-dihydroxy-diphenyl-1,1-isobutane, 4,4'-dihydroxy-diphenyl-4,4-heptane, 4,4'-dihydroxy-diphenyl-2,2-hexane, 4,4'-dihydroxy-triphenyl-2,2,2-ethane, 4,4'-dihydroxy-diphenyl-1,1-cyclohexane, 4,4'-dihydroxy-diphenyl-$\beta$-$\beta$-decahydronaphthalene, cyclopentane derivatives of 4,4'-dihydroxy-diphenyl-$\beta$-$\beta$-decahydronaphthalene, 4,4'-dihydroxy-diphenyl-sulphone, and the like. Suitable film forming thermoplastic polymers must be capable of forming a dispersion of electrically charged, thermoplastic film forming polymer particles in an organic liquid. The expression "dispersion" as used herein is defined as fine particles having an average particle size of less than 100 $\mu$m in diameter distributed in a liquid medium with no direct contact between the particles. Dispersions are well known and extensively described in the literature, for example, by James S. Hampton, "Hyperdispersant Technology For Nonaqueous Coatings", Modern Paint and Coatings, Jun. 1985, pages 46–54, the entire disclosure thereof being incorporated herein by reference. The dispersions employed in the process of this invention should be substantially free of polymer particle agglomerates. The express "substantially free of polymer particle agglomerates" as used herein is defined as free of any polymer particle agglomerates having a size larger than twice the average particle size of polymer particles in the dispersion. Agglomerates having a size larger than twice the average particle size of polymer particles in the dispersion can deposit onto the sleeve electrode and cause an irregular surface to form on the belt.

After acquiring an electrostatic charge, the theremoplastic film forming polymer particles should also be capable of migrating through the organic liquid medium of the dispersion under the influence of an electric field to form a uniform particulate coating on an electrode. The thermoplastic film forming polymer particles should also be substantially insoluble in the organic liquid dispersion medium at electrodeposition temperature but soluble in the organic liquid medium at elevated temperature after deposition on an electrode. During heating, the particles should be solubilized by the liquid medium to form a viscous continuous sol layer of the solubilized polymer particles and finally form a dry, continuous polymer film when continued heating evaporates the organic liquid dispersion medium. If desired, the thermoplastic film forming polymer particles may be only partially polymerized so as to have reactive groups available for further reaction during final curing. These partially cured polymer particles have a molecular weight of at least about 35,000 and may be subsequently reacted by cross linking, chain extension or other suitable mechanism to increase the weight average molecular weight of the polymer when the particulate coating on the mandrel is heated to coalesce the particles to form a sol coating and to evaporate the organic liquid to form a dry film. Typical examples of curable film forming polymer materials include prepolymers of polyimide, poly(amide-imide), polyurethanes, epoxy, polyesters, acrylics, alkyds, and the like. Depending on the nature of the polymer and catalyst employed, curing may be effected at room temperature (if deposition is conducted below room temperature) or with the application of heat, light and/or other radiation. Generally, the thermoplastic film forming polymer particles in the dispersions have an average particle size between about 0.01 micrometer and about 10 micrometers to remain in dispersion for practical periods of time. The dispersed polymer particles may be solids. Particles with a small diameter and large surface area form better dispersions than particles with a low surface area and large diameter. The dispersed polymer particles may be of any suitable shape. Typical shapes include spherical, ellipsoid, angular, acicular, platelet, polyhedral, irregular, porous and irregular, permeable and irregular, and the like.

Any suitable additive may be added to the polymer particle composition and/or dispersion medium. For example, the additive may be added to enchance wetting of the electrode, adjust electrical conductivity, alter dielectric properties, facilitate film removal, stabilize the dispersion and prevent agglomerate formation, increase the deposition rate, or act as an antioxident, thermal stabilizer, curing agent, reinforcing agent, dye or coloring agent, and the like. Generally, the total additive amount of release agent, sufactant and charge control agent added to the dispersion is less than about 10 percent by weight based on weight of dispersion solids.

The additive may comprise a minor amount of any suitable release agent to facilitate release of the polymer film formed on the electrode. When release promoting additives are placed into a polymer dispersion and hence are present in the belt after processing, the additives promote release by reducing the adhesive force to the mandrel. The additives may not necessarily provide self release per se of the belt from the mandrel with cooling to room temperature, but can reduce the adhesion of the belt to the mandrel an thus render it easier to remove by peeling. These are typically surface tension reducing materials such as fluororganic surfactants. These materials can also serve a dual function in that they can function a conditioning additives for the dispersion to prevent the formation of agglomerates, establish a linear relationship between film thickness and desposition time and give a steady current during the deposition. Typical release materials include, for example, mold release agents such as silicones, fluorocarbons, hydrocarbons, soaps, detergents, surfactants (e.g. Silwet L-7500, Silwet L-7602, available from Union Carbide Corporation GAFAC RA600 available from GAF Corporation), and the like. The release material may be added to the polymer part but should be compatible with the polymer. When added to the liquid dispersion medium, the release material should be compatible with the liquid dispersion medium and not phase separate. As a coating on an electrode, the release material is preferably not soluble in the liquid dispersion medium. Similiarly, release material in the polymer particles should be substantially insoluble in the liquid dispersion medium. Generally, the amount of release material added to the dispersion is less than about 10 percent based on the total weight of the dispersion solids. Preferably, the release agent is stable during electrodeposition and subsequent processing operations.

The additive may comprise a minor amount of surfactant to stabilize the dispersion and/or modify the surface charge on the polymer particles. The surfactant is surface active and added to the liquid dispersion medium to coat the particles, promote the formation of stable dispersions by steric repulsion effects, and modify the charge. A stable dispersion is one which does not settle or is one which is easily dispersible if some sedimentation occurs. The surfactant may, for example, be any suitable cationic, anionic, or amphoteric compound which can be dissociated in the organic liquid dispersion medium and absorbed onto the thermoplastic film forming particles to impart to them a net resulting surface charge which determines whether they migrate to the anode or cathode. Typical surfactants include fluorosurfactants (Zonyl FSC, available from E. I. du Pont de Nemours & Co.), fluorinated alkyl quaternary ammonium iodide (FC-135, a cationic surfactant available from 3M Company), cationic fluorosurfactant (Monflor-72, available from ICI American Inc.), and the like Zonyl surfactants are characterized as having an R group in the molecule which imparts to the molecules an extreme tendency to orientate at interfaces with low interaction between the fluorocarbon chains. The R groups can be, for example, fluoro, fluoromethyl ($CF_3$—), fluoroethyl ($CF_3CF_2$—), fluoropropyl ($CF_3CF_2CF_2$—), and the like. These fluorosurfactants lower the surface tension of solutions very well. Also, for example, Zonyl FSC surfactant is cationic and is soluble in organic dispersing mediums such as propylene carbonate and is believed to dissociate to lead to a positively charged ionic species with a fluorocarbon R group and a negatively charged species of an ionic type. It is hypothesized that the positively charged group is absorbed onto thermoplastic film forming particles such as polyvinyl fluoride which have partially dissociated negatively charged groups remaining on their surface. This results in fluorocarbon groups which sterically radiate from the polyvinyl fluoride particles and prevent agglomerate formation and further adds to the positive charge on the polyvinyl fluoride particles. This also causes an increase in the rate of deposition of the polyvinyl fluoride particles onto the cathode and the negatively charged species with some non-absorbed dissociated cationic surfactant resulting in an increase in the leakage current through the organic liquid dispersion medium. The dispersion can contain up to about 10 percent by weight surfactant based on the total weight of the dispersion solids.

The film forming particles must acquire a sufficient electrostatic charge in the liquid dispersion medium for electrodeposition. A charge control agent may be added to promote acquisition of sufficient electrostatic charge to migrate under the influence of an electric field. Typical charge control agents include the same dispersant additives listed above, including for example, Zonyl FSC surfactant, FC-135 flurorinated alkyl quaternary ammonium iodide, and other fluoro organic sufactants which are cationic and miscible with the liquid phase of the dispersion, and the like. Generally, the relative amount of charge control agent added to the dispersion may be up to about 10 percent by weight based on the weight of dispersion solids. This charge control agent may also perform other functions such as those of a release agent or dispersion stabilizer as described above. Sufficient charge control agents should be added to the dispersion to impart a charge to the film forming particles sufficient to achieve a deposition rate of at least about 0.5 micrometer per minute unlimited by the coating thickness of uncoalesced particles. Generally, between about 0.001 percent and about 10 percent by weight based on the weight of dispersion solids of charge control agent is employed if the film forming particles are nonpolar polymers. IF desired, the addition of charge control agents may be omitted for polar polymers. The addition of charge control agents can also contribute to agglomerate free coatings. Thus, incorporation of suitable additives such as lower alcohols e.g. methanol, ethanol and isopropanol or cationic surfactants can enhance the polymer particle deposition rate and minimize the formation of agglomerates.

Where desired, the thermoplastic film forming polymer particles may contain filler particles that are incorporated with the polymer particles prior to electrodeposition of the polymer particles. Any suitable filler particles may be added. The filler particles may be organic or inorganic. Typical filler particles include barium titanate, tin oxide, antimony tin oxide, calcium silicate (Wollastonite 200, available from NYCO Division of Processed Minerals, Inc. N.Y.), carbon black, magnetite, ultramarine blue, cobalt aluminate blue, chrome-cobalt-aluminate, chronium oxide, phthalocyanine green, quinacidones, diarylide yellow pigments, iron oxide, titanium-chrome oxide, vanadyl phthalocyanine, zinc oxide, cadmium sulfoselenide, and the like, and mixtures thereof. The filler particles should normally have an average particle size less than the film thickness of the final free standing film. The filler particles may be incorporated with the thermoplastic film forming polymer particles by any suitable technique. Typical incorporation methods include roll milling, attriting, mechanical mixing, melt mixing, and the like.

Generally, the amount of filler particles added to the thermoplastic film forming polymer particles can be as high as about 50 percent by weight based on the total weight of the filled thermoplastic film forming polymer particles. Large amounts of filler exceeding about 50 percent by weight can lead to more brittle films, whereas smaller amounts can lead to stronger films. Also, high loadings of conductive particles can render the disperison too conductive for deposition.

If desired, the free standing polymer films may be reinforced by any suitable reinforcing material such as fibrous material. Typical fibrous materials include screens, woven fabrics, and felts, wound filaments, randomly dispersed filaments, and the like. The filaments may be electrically insulating or conductive. Typical organic and inorganic fibrous materials include fiberglass, stainless steel filaments, knitted seamless tubes of nylon, rayon fabric, brass filaments, copper filaments, carbon fibers, ceramic fibers and whiskers, high aspect ratio minerals such as wollastonite cellulosic materials, and the like. Generally, the fibrous material is placed against the electrode surface and the thermoplastic film forming particles are thereafter electrodeposited onto the electrode to encapsulate the fibrous material. Reinforcement materials may enhance resistance of the free standing film to creep and increase modulus, break stress, electrical conduction and shielding. The reinforced belts acquire a smooth outer surface because the belt is formed on the inside surface of a cylindrical electrode. The side of the belt not in contact with electrode tends to exhibit a texture caused by the reinforcing material. The reinforcement material should have a thickness less than the thickness of the desired belt for optimum reinforcement value. Also, the reinforcing material is preferably dimensionally stable at the coalescing temperature of the deposited thermoplastic film forming polymer particles. In addition, the reinforcing material itself is preferably strong and not easily stretched under tension.

The dispersions employed in the proces of this invention comprise the film forming thermoplastic particles dispersed in an organic liquid dispersing medium. The polymer deposition rate is affected by various factors such as the concentration of the dispersion. Generally, the dispersions comprise between about 0.5 percent by weight and about 60 percent by weight thermoplastic film forming polymer particles based on the total weight of the dispersion with the remainder being primarily the organic liquid dispersion medium and up to about 10 weight percent additive. For optimum results, the amount of film forming thermoplastic particles in the dispersion is between about 10 percent and about 20 percent by weight based on the total weight of the dispersion. In a typical example, a dispersion prepared by mixing equal volumes of (1) a 33 percent by weight of polyvinylfluoride (PVF) dispersion in propylene carbonate with (2) additional propylene carbonate to yield about 17 percent by weight solids polyvinyl fluoride (PVF) dispersion in propylene carbonate gave a 80 μm (3mil) dry film in 3 minutes at −24 volts. When the concentration of the thermoplastic film forming polymer articles in the case of polyvinyl fluoride particles drops below about 10 percent by weight based on the total weight of the dispersion, the deposition rate decreases noticeably. When the concentration of the thermoplastic film forming polymer particles exceeds about 60 percent by weight, the deposition rate is high but the film thickness becomes uniform and uneven and too sensitive to polyvinyl fluoride particle concentration variations and thus the process is difficult to control.

Any suitable organic liquid dispersion medium may be employed to disperse the film forming thermoplastic polymer particles. The organic liquid dispersion medium should not dissolve the dispersed film forming thermoplastic particles at electrode position temperatures but at least one component thereof should sufficiently dissolve the particles at elevated temperatures to form a sol at temperatures below the boiling point of the solvent component of the organic liquid dispersion medium. Generally, the thermoplastic particles should be substantially insoluble in the liquid components in the organic liquid dispersing medium at temperatures employed during electrodeposition because the particles would otherwise agglomerate. The expression "substantially isoluble" is defined as a state of insolubility where the polymer particles do not form sintered agglomerates in the organic liquid dispersing medium at electrodeposition temperatures. The polymers, such as polyvinylfluoride, are substantially insoluble in organic liquids such as propylene carbonate solvent at room temperature but at elevated temperatures will coalesce and form a sol which, upon drying, forms a solid film. The word "sol" as used herein is defined as a high viscosity mixture in which the polymer is molecularly dispersed in the liquid dispersion medium. Because of the high molecular weight of the polymers employed and the minimal residual amount of liquid dispersion medium deposited, a viscous sol coating is formed at elevated temperatures rather than a free flowing dilute solution at elevated temperatures. Because the film forming thermoplastic polymer particles have a relatively high weight average molecular of at least about 35,000 and, because the amount of residual liquid dispersion medium clinging to the deposited particles is relatively small, a viscous sol is formed at elevated temperatures. At the elevated temperatures, the deposited particles sinter and coalesce to form a continuous, viscous sol coating during heating. Continuation of the heating evaporates the residual organic liquid dispersion mediuam and a continuous, homogeneous, dry polymer film is formed. Also, sol formation should occur below the boiling point of the solvent component of the organic liquid dispersion medium. Thus, the molecular weight of the polymers, the liquid dispersion medium components and elevated temperature are selected to achieve a high viscosity sol to avoid sagging.

More specifically, the solubility of the thermoplastic particles in the solvent component of the organic liquid dispersing medium should be greater than about 1 percent by weight based on the weight of the deposited particles at temperatures employed during the heating step to accelerate coalescence at elevated temperatures (sol stage). Further, when the solubility of the thermoplastic particles in the solvent component of the organic liquid dispersing medium is greater than about 1 percent, such solubility of the polymer particles in the clinging solvent results in penetration of the solvent into the deposited particles to form a molecular dispersion in the solvent which forms the sol. With solvent molecules present between polymer molecules, the latter freely entangle with adjacent polymer molecules which are in a similar environment and hence coalescence occurs to form the sol. Complete solubilization with a resulting low viscosity cannot occur because of the limited amount of residual solvent present and because the polymer molecules of the organic thermoplastic particles are sufficiently large to avoid becoming completely free of entanglement with adjacent polymer molecules. High viscosity is a necessary property for good coating and film formation on the electrode because low viscosity of a polymer solution would cause undesirable sagging to occur. In film formation, the minimum solubility required should be just sufficient to coalesce the polymer particles into a continuous sol. Thus, the polymer particles are substantially insoluble in the liquid dispersion medium at electrodeposition temperatures and when heated to a solvation temperature, sufficient solvent penetration into the particles occurs to cause entanglement of polymer molecules on adjacent particles to facilitate sintering, coalescence and sol formation. Below the solvation temperature, the polymer particles are segregated and above the solvation temperature, the polymer particles form a molecular dispersion in the residual solvent and mingle to form a sol. Futher heating is necessary to remove the solvent from the sol coating.

The organic solvent used in the organic liquid dispersion medium is preferably non-toxic for commercial use. It should have a low vapor pressure and, hence, a high boiling point that is higher than the temperature employed for electrodeposition. The organic liquid dispersion medium may also comprise a mixture containing another liquid which is a non-solvent for the particles regardless of temperature. However, the mixture should contain sufficient solvent liquid to solubilize and coalesce the polymer particles at elevated temperatures to form a sol. For example, the organic liquid dispersion medium may comprise a 30 percent solvent and about 70 percent by weight of a non-solvent. If a non-solvent (regardless of temperature) is present in the organic liquid dispersion medium, it should evaporate at a lower temperature than the solvent. The solvent or non solvent dispersion liquid medium component may also function as a release agent, charge control agent, or surfactant. The solvent component does not dissolve the polymer particles at room temperature nor at temperatures up to the boiling point temperature of any liquid non-solvent component. However, the solvent must solvate and molecularly disperse the polymer molecules at the elevated temperature achieved during the heating step. Thus, relatively boiling solvents, such as propylene carbonate, are highly desirable. The high boiling solvents provide a dispersion medium at electrodeposition temperatures, allow sol formation at elevated temperatures, remain sufficiently long to level the coating and permit solvent removal from the coating upon still further heating at a temperature above the solvation temperature of the polymer so that only a low residual amount of solvent remains in the resulting dry polymer film after a reasonable heating time. However, drying temperatures lower than the sol formation temperature may be used after sol formation if, for example, heat sensitive process elements are used. Thus, the expression "dry polymer film" is intended to include completely dried films as well as films that contain a low residual amount of liquid dispersion medium material. More specifically, the solidified, dry polymer film contains less than about 5 percent by weight of the residual liquid dispersion medium material based on the total weight of the solidified, dry polymer film. Thus, it is an important property of the solvent that at elevated temperatures it facilitates the transition of the polymer particles from a segregated state to a coalesced state.

With the teachings hereinabove and hereinafter, the relationship between solvation temperature and solubility parameters of latent solvents can readily be determined by experimentation. Typical combinations of polymer and organic liquid dispersion medium include polyvinylfluoride and propylene carbonate, isophorone, N-methyl pyrrolidone, N,N-dimethyl formamide, butyrolacetone, dimethyl phthalate, acetophenone, acetyl triethyl citrate, aniline, n-butyl levulinate, dibenzyl ether, dibutyl fumarate, di-n-butyl maleate, dibutyl phthalate, di-n-butyl succinate, dibutyl tartarate, di(2-ethyl hexyl)phthalate, diethyl phthalate, diethyl maleate, diethyl phthalate, diethyl sebacate, dimethyl adipate, dioctyl adipate, ethyl levulinate, quinoline, o-toluidene, triacetin, tributyl citrate, tributyl phosphate, triethyl citrate or triethyl phosphate. Typical solvation temperature/solubility parameter relationships for polyvinyl fluoride and selected solvents include butyl carbinol (77° C./10), diethyl phthalate (155° C./10.1), dimethyl phthalate (148° C./10.3), isophorone (139° C./9.9), N-methyl pyrrolidone (122° C./11.3), N,N-dimethyl formamide (103° C./12.3), butyrolacetone (118° C./13), propylene carbonate (128° C./13.2). Another example of a combination of polymer and organic liquid dispersion medium is polyvinylidene fluoride and butyrolacetone, isophorone, carbitol acetate, methyl isobutyl ketone, n-butyl acetate, cyclohexanone, diacetone alcohol, diisobutyl ketone, ethyl aceto acetate, triethyl phosphate, propylene carbonate, or dimethyl phthalate. Still other examples include combinations of propylene carbonate organic liquid dispersion medium with a polymer of nylon, polyvinyl chloride, polyvinyl chloride-polyvinylidene chloride or polyvinylidene chloride-polyacrylonitrile. In a typical example, an electrodeposited coating of PVF in propylene carbonate is heated to about a solvation temperature of about 128° C. to form a homogeneous, viscous sol coating and then heated to about 180° C. to form a dry solid film. The boiling point temperature of propylene carbonate is about 242° C. These conditions lead to the formation of excellent belts. The solvation temperature of the polymer particles was above the electrodeposition temperature and the drying temperature for the sol coating was above the solvation temperature of the particles, but below the boiling point temperature of the liquid dispersion medium material.

The dispersion should be substantially free of water because it can cause polymer agglomerates and chunks to form in the final film. Water also prevents or retards electrodeposition rate. The expression "substantially free of water" as employed herein is defined as less than about 10 percent based on the total weight of the liquid dispersion medium. Generally, the dispersion mixture should have sufficient electrical conductivity to support a linear relationship between the film thickness and deposition time. A preferred electrical conductivity for the dispersion mixture is between about $4\times10^{-8}$ mho/cm and about $1.0\times10^{-3}$ mho/cm for optimum current and particle deposition rates. At a conductivity below about $4\times10^{-8}$ mho/cm dispersed polymer particles in the dispersion medium are difficult to maintain and particle agglomeration can occur. At conductivities above about $1\times10^{-3}$ mho/cm, the ionic conductivity of the organic liquid medium becomes too great and leakage current accounts for the majority of the current flow or charge migration through the dispersion medium. Minimum particle migration occurs because the particles are large in size compared to ions, i.e. the ions are significantly smaller by many magnitudes. The polymer particles do not appear to contribute to any significant portion fo the current during the deposition. Most of the current during deposition is due to leakage through the solvent and is believed due to ionic conductivity. If desired, the dispersion mixture may be modified by additional material. Thus, for example, the conductivity of the dispersion may be altered to the desired value by the incorporation into the dispersion mixture of minor amounts of additives such as surfactants described above or relatively large amounts of a second organic liquid. An example of such a second organic liquid is alcohols. The addition of alcohol can alter conductivity thereby permitting conductivity adjustments to achieve a level at which satisfactory polymer particle deposition occurs. The change in conductivity of the organic liquid phase is believed due to ion species residing on the surface of the polymer particles in the liquid dispersion medium. The counter charge resides on the particle and results in more charge on the polymer particles thereby.enhancing migration. However, the measured current and higher conductivity of the dispersion are due to the ions in the solvent. The dispersed polymer particles migrate to the electrode but on arrival do not charge exchange completely due to the insulating nature of the particles. The charge which resides on the polymer particles in a region which does not contact the electrode remains and holds the particle onto the electrode. If the electrode is removed from the dispersion and a conductive liquid applied to the particles on the electrode complete charge exchange would occur and the particles would loose their adhesion and wash away with the conductive liquid. This will not occur with insulating liquids. In a typical mixture, a lower alcohol such as about 100 ml of methanol has been added to about 450 ml of polyvinyl fluoride dispersion (of about 33 weight percent PVF in propylene carbonate, available from E. I. du Pont de Nemours & Co.) with about 350 ml of propylene carbonate to render the dispersion more electrically conductive. When the dispersion is too insulating and the polymer particle deposition process is repeated to fabricate a pluarlity of free standing polymer films from the same dipersion bath, agglomerates tend to form due to localized electrical charges in the dispersion. These agglomerates deposit on the electrode and gave the films a coarse, grainy texture. Thus, it is believed that an alcohol such as methanol renders the polymer particles more ionic and leads to higher deposition rates with steady currents. The current is steady because the film build-up is not limited by the insulating nature of the particles. The current that flows during the deposition is primarily the leakage current and not due to the polymer particles migrating to the cathode and undergoing charge exchange. Other suitable lower alcohols may also be used to control degree of ionization of surface charges on the polymer particles or conductivity. As indicated above, a preferred electrical conductivity for the dispersion mixture is between about $4\times10^{-8}$ mho/cm and about $1.0\times10^{-3}$ mho/cm. Typical alcohols include methanol, ethanol, isopropanol, and ethylene glycol. The alcohols should contain from 1 to 3 carbon atoms. Generally, the amount of low boiling alcohols added to the dispersion should be minimized to avoid bubble formation in the film during heating due to alcohol trapped in the film. An illustrative preferred dispersion comprises about 4.5 parts by weight of a 33 precent by weight solids dispersion of polyvinyl fluoride (PVF) in propylene carbonate (Tedlar 4000, available from E. I. du Pont de Nemours & Co.) diluted with about 4.5 parts by weight of propylene carbonate and about 1 part by weight methanol. This composition is preferred because it provides a good deposition rate and high quality film and the film thickness is not limited during deposition. Instead of an alcohol, suitable mixtures of organic liquid dispersion mediums with other organic liquid additives may be used. Typical organic liquid additives include dimethyl adipate, dimethyl glutarate, and dimethyl succinate, acetic acid, formic acid, monoethanolamine, diethanolamine, thiethanolamine, monoethanolamine, diemthylaminoethanol, and the like.

Any suitable cylindrical electrode sleeve material having an electrically conductive surface at or immediately adjacent to its interior surface may be used for the electrode. The electrode is preferably dimensionally and thermally stable at the processing temperatures utilized. It also should be insoluble in organic liquid dispersion medium employed in the dispersion and should not react chemically with the thermoplastic film forming particles or other components of the dispersion mixture. The electrode may be uncoated or, if desired, be coated with a suitable release coating prior to applying coatings that are used to form the ultimate seamless belt. Typical metallic electrode materials include aluminum, stainless steel, nickel, chromium, copper, gold, brass, and the like. Typical polymeric electrode materials include polyethylene, polypropylene, polymethylpentene, copolymers thereof, nylon, fluoropolymers thereof, and the like, coated with or filled with an electrically conductive material. Typical inorganic and ceremic electrode materials include glass, graphite, carbon, clay and the like coated, if desired, with an electrically conductive coating. The electrode may be formed by extrusion, molding, blow molding, injection molding, casting and the like to achieve the desired shape. For best release, the electrode surface or coating thereon preferably has a critical surface tension of less than about 31 dynes/cm. Electrodes having an outer surface of steel, nickel, aluminum, chromium, gold or graphite are particularly preferred because they contribute to the release of the completed film after it is heated and cooled. Electrodes composed entirely of nickel, steel or aluminum are examples of materials which can be employed as self supporting eletrodes. Although less desirable, the electrode may be disposable and may, for example, be destroyed during removal of the deposited belt. If the electrode is to be destroyed, it should be accomplished without adversely affecting the free standing film such as by using a liquid that dissolves or chemically reacts with the electrode but not the film. Electrodes may also be provided with non-conductive areas to form sprocket holes; a timing mark or other desired aperture. Typical sprocket holes and apertures may be from several mm to about 25 μm in size. Furthermore, free standing films with patterned surfaces may be prepared by using an electrode that has a pattern on its molding surface rather than a smooth surface. The interior of the electrode is cylindrical in shape. Electrode may also be provided with releasable conductive coatings to form a uniform layer or pattern of lines, dots or holes of conductive areas on the outside surface of free standing films. Further, the electrode may also be patterned on one or both ends along the edge of the cylinder to produce films with increased thickness in those areas for edge reinforcement or to project inwardly or outwardly to guide or track the endless belt by abutting against edge guide flanges at the ends of drive rollers. The thickness at the edges may, for example, be up to 5 times greater than the film thickness and extend across the film for a distance up to about 3 cm. Thus, the electrode surface on which the film forming polymer particles deposit functions as a molding surface for the belt loop formed by the process of this invention. In a typical example, a belt is formed on the inside surface of a smooth surfaced cylindrical, nickel electrode, using a polyvinylidene fluoride (PVDF) with a surface energy of 25 dynes/cm which is self releasing from the nickel electrode.

When the electrode is to be coated with a suitable release coating prior to contact with the dispersions that are used to form the ultimate free standing film, the surface tension relationship between the outer surface of the coated electrode and the polymer should be selected so that the polymer film is subsequently removable from the electrode surface after the final free standing film is formed. Generally, the release material may be selected from any suitable type. These release materials include solid reusable polymeric materials coated on an electrode, a liquid or dispersion which is applied as a coating to an electrode, and a liquid or powder that may be added to the dispersion or dispersion component to promote release. Typical release materials include silicones (e.g. E-155 silicone release coating and SWS F-544 cured with F-546 catalyst, both available from SWS Silicones (name changed to Wacker Silicones) and Dow Corning 20, available from Dow Corning Corp.); fluorocarbon polymers such as polyvinylidene fluoride (e.g. Kynar 7201, Kynar 301F, Kynar 202 and Kynar 301F, available from Pennwalt Co.), polytetrafluoroethylene (e.g. Teflon, available from E. I. du Pont de Nemours & Co.) and filled polytetrafluoroethylene (e.g. Teflon S, available from E. I. du Pont de Nemours & Co.); polyethylene; polypropylene; phenolic resins; polyphenylene sulfide resins; hydrocarbons (e.g. Frekote 44, available from Freekote Corp.); soaps; detergents; and the like and mixtures thereof.

When release coatings are employed, the release coatings are preferably applied to a clean electrode surface. Conventional industrial procedures such as metal polishing followed by chemical washing, solvent cleaning and degreasing of the electrode prior to application of the release coating may be utilized. Depending upon the initial condition of the electrode surface, it may be desirable to remove dirt, rust, mill scale, paint, oil and the like. Addesion of the release coating to the electrode surface may be improved by grit blasting or by conversion of coatings typically employed on metal substrates such as zinc manganese, ion phosphates, chromates, and the like. Any suitable method may be employed to apply the release coating to the electrode. Typical coating techniques include dip coating, spray coating, brush coating, bar coating, flow coating, spin coating and the like. Other important characteristics of the release coating include electrical conductivity, solvent resistance, temperature stability and durability. The release coating preferably has all these properties. Generally, the electrical conductivity of the release coating should be at least about $1\times10^{-5}$ mho/cm. Electrically insulating release coating material may be rendered conductive by the addition of any suitable conductive additive. Typical conductive additives include carbon black, metal particles, metal oxides conductive fibers, graphite, polyacetylene, and the like. In a typical example, silicone elastomers and silicone resins were loaded with carbon black to render them electrically conductive. The carbon black loaded silicones gave good results at a loading of about 10 percent by weight based on the total weight of the final release coating. This gives the coating a rough surface appearance which further adds to the adhesion of the release coating to the electrode. Charge exchange is not necessary, provided that a field exists to hold the particles. The polymer particles migrate under the influence of an electric field which is small whereas the polymer particles have considerable charge. A leakage current can flow but its magnitude does not appear important. The thickness of the release coating should be continuous and preferably less than about 2 micrometers and with an optimum thickness of less than about 1 micrometer.

The free standing thermoplastic belts fabricated by the process of this invention should be thin and flexible. In general, the entire process of obtaining a thick free standing polymer belt with thicknesses as great as about 500 micrometers (20 mils) are greatly simplified by the method of this invention. Film thickness of up to about 75 mircometers may be obtained within relatively short deposition time periods. The thickness of the flexible belt depends on numerous factors, including economical considerations and whether the film constitutes the only layer in the final product. Thus, film may be of substantial thickness, for example, as thick as about 500 micrometers, or as thin as about 5 micrometers. When the film is a belt to be used in an electrostatographic imaging member, e.g. electrophotographic or electrographic imaging member, the thickness of the film should be selected to avoid any adverse effects on the final device. Substrates that are too thin can split and exhibit poor durability characteristics. When the substrate is excessively thick, early failure during cylcing and higher cost for unnecessary material are often observed. An insulating substrate comprising amorphous polymers such as polyvinylfluoride, polyamide-imide, polyimide, polyurethane and polyvinylidene fluoride having a molecular weight of from about 35,000 to about 1,500,000 are particularly preferred because the resulting film is mechanically strong and resists crazing and cracking when exposed to solvents employed in any subsequently applied coatings such as during the fabrication of electrostatographic imaging members. The bely may comprise a conductive layer or an insulating layer. If the electrodeposited film is insulating and is intended to be employed in an electrostatographic imaging member, it is normally coated with one or more additional layers such as a conductive layer.

Generally, the electrodeposition process of this invention involves providing at least one sleeve electrode coaxially spaced apart from at least one other electrode in a bath comprising a dispersion of electrically charged, thermoplastic film forming polymer particles in an organic liquid dispersion medium, the polymer particles having a weight average molecular weight of at least about 35,000 and being substantially insoluble in the organic dispersion liquid medium at electrodeposition temperatures and sufficiently soluble in the organic dispersion liquid medium at elevated temperatures to coalesce and form a viscous coating, applying an electric filed across the electrodes until a thick, substantially uniform deposit of polymer particles forms on the interior surface of the sleeve electrode, removing the sleeve electrode bearing the deposit of polymer particles and residual liquid dispersion medium clinging to the deposit of polymer particles from the bath, heating the deposit to initially solubilize the polymer particles in the residual organic liquid dispersion medium to form a coalesced, continuous, viscous, sol coating of the solublized polymer particles, continuing the heating to evaporate the residual organic liquid dispersion medium and form a continuous, solidified, dry, cylindrical polymer film, and removing the continuous, dry polymer film from the interior surface of the sleeve electrode. The distance between the electrodes is typically from about 1 cm to about 30 cm. Generally, it appears that electrode spacing does not have a significant effect on the quality of the deposition. However, an ultimate limiting spacing may exist where the efficiency would decrease beyond the point of practically. The voltage applied to the electrodes depends upon various factors such as the spacing between the electrodes, the deposition area of the electrode where the deposits form, electrical resistance of the dispersion, electrical charge on the particles, and temperature. In a typical example where the electrode spacing is about 14.6 cm and the deposition area is about 3,442.2 $cm^2$, the voltage can be, for example, between about 5 volts and about 24 volts. Generally, sufficient voltage is applied across the electrodes when an adequate deposition rate of at least about 0.5 micrometer per minute is achieved. The optimum applied voltge varies with the materials utilized. Preferably, the lower end of the usable applied voltage range is preferred to minimize the formation of agglomerates.

The concentration of the dispersion affects the rate of deposition. For example, increasing the dispersion concentration of a PVF dispersion by a factor of two, increased the film thickness from about 25 micrometers to 50 micrometers for 3 minute deposition periods at −24 volts. Thus, the concentration of the particles in the dispersion is preferably between about 1 percent by weight and about 35 percent by weight based on the total weight of the dispersion. For PVF, the optimum range is between about 10 percent by weight and about 20 percent by weight based on the total weight of the dispersion.

The electrodeposition of thermoplastic film forming polymer particles to form solid free standing films is a unique process in that thick polymer films can be made which are uniform without any sagging of the electrodeposited coating. The reason for this is believed to be that the process forms a high solids coating of polymer particles on the surface of the electrode which is held there by the electrical characteristics of the dispersion medium clinging to the particles and their surface charge. When this is subsequently heated to solubilize the polymer particles in the organic liquid dispersion medium the particles coalesce and form a very high viscosity solution that is a sol. The viscosity is due in part to the polymer having a high molecular weight of at least about 35,000 and the limited amount of solvent available during heating. The polymer sol coating under these conditions does not sag and therefore films of uniform thickness are formed. Further heating removes the organic liquid dispersion medium from the film and the latter is removed from the electrode after cooling.

A particularly preferred electrodeposition process involves the use of a cylindrically shaped electrode having a polished inside surface upon which the thermoplastic film forming particles deposit. A conductive rod is positioned as the other electrode along the imaginary axis of the cylindrical electrode. This pair of electrodes is immersed in the dispersion of thermoplastic film forming particles in an organic liquid dispersion medium. The thermoplastic film forming particles deposit on the inside surface of the cylindrically shaped electrode when a low voltage is applied to the electrodes. For example, in the electrodeposition of polyvinyl fluoride to form seamless belts on the interior surface of a cylindrically shaped electrode having a diameter of 26.97 cm (10.62 in) and length of 152.4 cm (16 in), typical operating conditions include a low voltage of about −24 volts and a current of about 25 mA for a deposition time of about 7 minutes. After a suitable amount of the thermoplastic film forming particles have been electrodeposited on the interior surface of the cylindrical electrode, the cylindrical electrode is removed from the dispersion and placed into an oven. The electrodeposited particles contain residual liquid dispersion medium clinging to the particles. The ends of the cylindrical electrode are covered with any suitable means such as caps to retard residual coalescing solvent from evaporating, to facilitate solvation and to ensure complete coalescence and formation of a sol. During heating, the thermoplastic film forming particles becomes soluble in the residual organic liquid dispersion medium at elevated temperatures and form a uniform, continuous sol film. The end seals on the cylinder are then removed to facilitate evaporation of the residual solvent. One or both ends may subsequently be opened to facilitate rapid drying. With further heating, the residual organic liquid dispersion medium evaporates from the film to leave a solidified, cylindrical, homogeneous dry film on the inside of the cylindrically shaped electrode. When evaporation is substantially complete, the cylindrically shaped electrode is removed from the oven and allowed to cool at room temperature after which the seamless belt is removed from the inside of the cylindrically shaped electrode. This process can be used to prepare flexible seamless belts of precise size and thickness. The thin belts have flexibility suitable for various imaging systems including photoreceptor substrates, as dielectric receivers, and the like.

If desired, additional thermoplastic film forming polymer particles, organic liquid dispersion medium and/or additives may be added to the dispersion to replenish material consumed during the production of multiple free standing polymer films from the same bath and to maintain the dispersion at constant volume.

The thick deposited layer of polymer particles are formed into thick, solid and uniform films without any sagging. The coating of polymer particles on the surface of the electrode is held in place on the inner surface of the electrode by the surface charge on the particles. Upon heating, the polymer particles are solubilized in the organic liquid dispersion medium to coalesce and form a high viscosity sol coating that resists sag. The coalescence step requires that residual solvent be present to facilitate the formation of a sol. To promote this, the ends of the cylinder electrode are covered to retard solvent evaporation. The degree of covering, if any, depends on variouos factors such as the temperatures employed, the degree of solubility of the polymer in the solvent, and the like. Thus, covering of the ends of the drum during heating is preferred to ensure the formation of a coalesced, viscous, homogeneous, sol layer. The end seals are then removed to evaporate the solvent. A single stage or multistage ramp heating procedure may be used, if desired, to reduce process time. Vacuum drying may also be employed to improve drying time without an increase in temperature. Moreover, solvent extraction with a second solvent may be utilized provided that the second solvent does not dissolve the polymer. Continued heating removes the organic liquid dispersion medium from the resulting continuous film. The coalescence time is dependent to a high degree on the thickness of the electrode onto which the polymer is deposited. Larger wall thicknesses require longer heating times. Thin walled electrodes are preferred as the particle deposition surface because the deposited layer of particles can be heated more rapidly by application of heat to both sides of the layer. Heating too rapidly may cause bubbles to form in the film. If heating is too slow non-uniform coalescence may occur. The rate of heating should be sufficient to evaporate a sufficiently large amount of solvent in a reasonable time without bubble formation to form a uniform layer.

The forces that contribute to adhesion of the belt to the electrode comprise a component which includes the wetting of the polymer onto the electrode. This wetting component can be driven by factors such as acid/base interactions, van der Waals' forces, electrostatic attraction, and surface energy relationships. A force which acts to overcome these adhesive forces and drives the release of the belt from the electrode is that which results from the relaxation of the belt during the cooling process. Since the belts are formed on the inside surface of the electrode, shrinkage of the electrodeposited polymer after drying and cooling greatly facilitates belt removal. The heating of polymer particles to initially coalesce them into a uniform, continuous sol layer on the electrode occurs at an elevated temperature. Upon further heating to dry the deposited layer followed by cooling, the belt shrinks. This develops a force between the belt and the electrode. When this force is greater than the adhesive force that holds the belt to the electrode, as results with cooling, the belt is released from the electrode. Release may be augumented by supplying abhesive materials to the electrode, the film coating, or both. The difference in surface energy between the electrode and the belt appears to be a major component which contributes to the adhesive force that holds the belt to the electrode. Belt material shrinkage due to drying, crosslinking, and the coefficient of expansion properties of both the electrode and the final film may be utilized to facilitate removal of the film from an electrode.

For film materials that are difficult to remove from an electrode, it is preferred that the film be electrodeposited on the inner surface cylindrical sleeve electrodes coated with a release coating. If desired, a fluid may be introduced between the film and electrode prior to removing the film from the electrode further reducing adhesion between the electrode and the electrodeposited film. The fluid may comprise one or more jets of air or a liquid introduced at one or both ends of the electrode between the electrode surface and the belt. The jets of fluid may be heated or at room temperature. Moreover, the jets of fluid can be injected between the belt and the electrode surface while the deposited belt material is at a temperature above the apparent $T_g$ of the solid coating layer or layers of the belt.

When employed, rapid quenching of the coated electrode by immersion in a liquid bath can serve the dual purpose of cooling the coating and introducing a fluid between the coating and electrode prior to removing the belt from the electrode. Water from a water bath penetrates between the belt and electrode to give release with no stretch marks. Ionized air or moisturized air may also be utilized to promote removal of the belt from the electrode by neutralizing static charges on the belt. In addition, ultrasonic energy may be applied to the electrode and/or belt to facilitate removal of the belt.

Belts may, if desired, be cleaned prior to coating by any suitable technique such as by washing in water alone, with soap and water, solvents, air impingment, and the like to remove surface contamination such as residual release material, dirt, oils, fibers, and the like. After cleaning the belt formed may, if desired, be corona treated, etched, flame treated and the like to improve adhesion of subsequently applied coatings.

The belt formed on the electrode may comprise a single layer or a plurality of layers applied to the electrodeposited film by suitable coating techniques such as spraying, brushing and the like while the electrodeposited film is still on the electrode. Thus, for electrostatographic imaging belts, the electrodeposited substrate layer or a single layer having the combined functions of separate substrate and ground plane layers can be formed on a cylindrical electrode with or without application of a blocking layer, photogenerating layer, transport layer, and an overcoating layer prior to separation of the deposited layers from the cylindrical electrode. Additional layers may be applied to the electrodeposited belt following removal of the belt from the electrode.

Various layers may be applied to the belt after it is formed. Conductive layers are particularly desirable for the ground plane of electrostatographic imaging members. As indicated hereinabove and hereinbelow, electrically conductive material may be incorporated into the initially electrodeposited coating or may be applied as a subsequently applied layer. More specifically, the conductive layer may comprise a film forming binder containing dispersed conductive particles. If desired, the seamless substrate itself may be rendered electrically conductive by the incorporation of conductive particles in a polymer binder material at a sufficient loading to provide the electrical conductivity desired. A typical conductive particle loading is from 10 percent to about 35 percent by weight based on the total weight of the layer. Typical conductive particles include inorganic or organic materials such as carbon black, metal powders, polyacetylene, $SnO_2$ doped with antimony or indium, conductive zinc oxide, and the like.

The conductive layer composition is preferably a sprayable composition including, for example, finely divided aluminum, titanium, nickel, chromium, brass, gold, stainless steel, carbon black, graphite and the like dispersed in a film forming polymer binder such as the polymers employed in the nonconductive layer described hereinabove and herein below. This sprayable composition may be applied to either or both sides of the electrodeposited polymer film. If a solvent is used for the binder in the sprayable composition, the solvent should preferably not adversely affect the electrodeposited polymer film or the electrode. If applied to the electrode prior to deposition of the polymer film, the conductive layer should be releasable from the electrode. Release may be achieved by any conventional technique such as by coating the electrode with a release coating, adding a release agent to the conductive layer composition, and the like.

The conductive layer may vary in thickness over substantially wide ranges depending on the desired use of the final belt. Satisfactory thicknesses for the conductive layer generally range from about 0.03 micrometer to about 20 micrometers when the conductive layer is applied to a previously formed electrodeposited polymer film. When a flexible electrostatographic imaging device is desired, the thickness of the conductive layer may be as thin as about 0.03 micrometer or as thick as about 5 micrometers. A conductive layer that is too thick tends to waste material and adversely affects belt flexibility whereas a conductive layer that is unduly thin may not be uniformly conductive.

When the electrodeposited polymer film of this invention is intended to be employed in an electrostatographic imaging member, other layers may be applied to the electrically conductive layer prior to or after removal of the film from the electrode. The layers applied to the electrically conductive layer may comprise a blocking layer, an adhesive layer, a photoconductive layer or a combination of these layers with or without additional layers.

Any suitable blocking layer or layers may be applied as one of the imaging member coatings of this invention. Typical blocking layers include gelatin (e.g. Gelatin 225, available from Knox Gelatine Inc.), and Carboset 515 (B. F. Goodrich Chemical Co.) dissolved in water and methanol, polyvinyl alcohol, polyamides, gamma-aminopropyl triethoxysilane, and the like, used alone or in mixtures and blends. Blocking layers generally range in thickness of from about 0.01 micrometers to about 2 micrometers, and preferably have a thickness of from about 0.1 micrometer to about 1 micrometer. Thicknesses outside these ranges may be selected provided the objectives of the present invention are achieved. The blocking layer may be applied with any suitable liquid carrier. Typical liquid carriers include water, methanol, isopropyl alcohol, tetrahydrofuran, ketones, esters, hydrocarbons, and the like.

Any suitable adhesive layer may be applied as one of the imaging member coatings of this invention. Typical adhesive layers include polyesters (e.g. du Pont 49,000, available from E. I. du Pont de Nemours & Co.), 2-vinylpyridene, 4-vinylpyridine and the like. Adhesive layers generally range in thickness of from about 0.05 micrometer to about 2 micrometers, and preferably have a thickness of from about 0.1 micrometer to about 1 micrometer. Thicknesses outside these ranges may be selected provided the objectives to the present invention are achieved. The adhesive layer may be applied with a suitable liquid carrier. Typical liquid carriers include methylene chloride, methanol, isopropyl alcohol, ketones, estes, hydrocarbons, tetrahydrofuran and the like.

Any suitable photoconductive layer or layers may be applied as one of the imaging member coatings of this invention. The photoconductive layer or layers may contain inorganic or organic photoconductive materials. Typical inorganic photoconductive materials include well known materials such as amorphous selenium, selenium alloys, halogen-doped selenium alloys such as selenoium-tellurium, selenium-tellurium-arsenic, selenium-arsenic, and the like, cadimum sulfoselenide, cadmium selenide, cadmium sulfide, zinc oxide, titanium dioxide and the like. Inorganic photoconductive materials are normally dispersed in a film forming polymer binder. Typical organic photoconductors include phthalocyanines, quinacridones, pyrazolones, polyvinylcarbazole-2,4,7-trinitrofluorenone, anthracene, azo, diazo, bisazo, squarylium, perylene pigments and the like. Many organic photoconductive materials may also be used as particles dispersed in a resin binder.

Any suitable multilayer photoconductors may also be employed in the imaging member of this invention. The multilayer photoconductors comprise at least two electrically operative layers, a photogenerating or charge generating layer and a charge transport layer. The charge generating layer and charge transport layer as well as the other layers may be applied in any suitable order to produce either positive or negative charging photoreceptors. For example, the charge generating layer may be applied prior to the charge transport layer as illustrated in U.S. Pat. No. 4,265,990 or the charge transport layer may be applied prior to the charge generating layer as illustrated in U.S. Pat. No. 4,346,158, the entire disclosures of these patents being incorporated herein by reference.

The photogenerating layer may comprise single or multiple layers comprising inorganic or organic compositions and the like. One example of a generator layer is described in U.S. Pat. No. 3,121,006 wherein finely divided particles of a photoconductive inorganic compound are dispersed in an electrically insulating organic resin binder. Useful binder materials disclosed therein include those which are incapable of transporting for any significant distance injected charge carriers generated by the photoconductive particles. Thus, the photoconductive particles must be in substantially contiguous particle to particle contact throughout the layer for the purpose of permitting charge dissipation required for cyclic operation. Thus, about 50 percent by volume of photoconductive particles is usually necessary in order to obtain sufficient photoconductive particle to particle contact for rapid discharge.

Examples of photogenerating layers include trigonal selenium, various phthalocyanine pigments such as the X-form of metal free phthalocyanine described in U.S. Pat. No. 3,357,989, metal phthalocyanines such as copper phthalocyanine, quinacridones available from DuPont under the tradename Monastral Red, Monastral violet and Monastral Red Y, substituted 2,4-diaminotriazines disclosed in U.S. Pat. No. 3,442,781, and polynuclear aromatic quinones sold under the tradenames Indofast Double Scarlet, Indofast Violet Lake B, Indofast Brilliant Scarlet and Indofast Orange. Examples of photosensitive members having at least two electrically operative layers include the charge generator layer and diamine containing transport layer members disclosed in U.S. Pat. Nos. 4,265,990, 4,233,384, 4,306,008, and 4,299,897; dyestuff generator layer and oxadiazole, pyrazalone, imidazole, bromopyrene, nitrofluourene and nitronaphthalimide derivative containing charge transport layers members disclosed in U.S. Pat. No. 3,895,944; generator layer and hydrazone containing charge transport layers members disclosed in U.S. Pat. No. 4,150,987; generator layer and a tri-aryl pyrazoline compound containing charge transport layer members disclosed in U.S. Pat. No. 3,837,851; and the like. The disclosures of these patents are incorporated herein in their entirety.

Photogenerating layers containing photoconductive compositions and/or pigments and the resinous binder material generally range in thickness of from about 0.1 micrometer to about 5 micrometers, and preferably have a thickness of from about 0.3 micrometer to about 1 micrometer. Thicknesses outside these ranges may be selected provided the objectives of the present invention are achieved. The photogenerating composition or pigment may be present in the film forming polymer binder compositions in various amounts. For example, from about 10 percent by volume to about 60 percent by volume to about 90 percent by volume of the film forming polymer binder composition, and preferably from about 20 percent by volume to about 30 percent by volume of the photogenerating pigment may be dispersed in about 80 percent by volume to about 70 percent by volume of the film forming polymer binder composition. The particle size of the photoconductive compositions and/or pigments should be less than the thickness of the deposited solidified layer and, more preferably between about 0.01 micrometer and about 0.5 micrometer to facilitate better coating uniformity.

Any suitable transport layer may be applied as one of the imaging member coatings of this invention to form a multilayered photoconductor. The transport layer may contain a film forming polymer binder and a charge transport material. A preferred multilayered photoconductor comprises a charge generation layer comprising a layer of photoconductive material and a contiguous charge transport layer of a polycarbonate resin material having a molecular weight of from about 20,000 to about 120,000 having dispersed therein from about 25 to about 75 percent by weight of one or more compounds having the general formula:

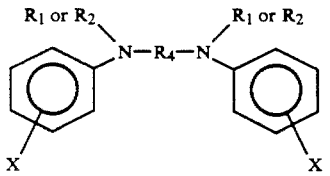

wherein $R_1$ and $R_2$ are an aromatic group selected from the group consisting of a substituted or unsubstituted phenyl group, naphthyl group, and polyphenyl group, $R_4$ is selected from the group consisting of a substituted or unsubstituted biphenyl group, diphenyl ether group, alkyl group having from 1 to 18 carbon atoms, and cycloaliphatic group having from 3 to 12 carbon atoms and X is selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting the holes through the charge transport layer. Examples of charge transporting aromatic amines including those represented by the structural formula above and others for charge transport layers capable of supporting the injection of photogenerated holes of a charge generating layer and transporting the holes through the charge transport layer include N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder. Examples of some of these transport materials are described, for example in U.S. Pat. No. 4,265,990 to Stolka et al, the entire disclosure thereof being incorporated herein by reference. Other examples of charge transport layers capable of supporting the injection of photogenerated holes of a charge generating layer and transporting the holes through the charge transport layer include triphenylmethane, bis(4-diethylamine-2-methylphenyl) phenylmethane; 4'-4''-bis(diethylamino)-2',2''-dimethyltriphenyl methane and the like dispersed in an inactive resin binder. Numerous inactive resin materials may be employed in the charge transport layer including those described, for example, in U.S. Pat. No. 3,121,006, the entire disclosure of which is incorporated herein by reference. The resinous binder for the charge transport layer may be identical to the resinous binder material employed in the charge generating layer. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpenetenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-alkyd resins, and the like. These polymers may be block, random or alternating copolymers.

Generally, the thickness of the solidified transport layer is between about 5 microns to about 100 microns, but thickness outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the solidified charge transport layer to the charge generator layer is preferably maintained from about 2:1 to 200:1 and in some instances as great as 400:1.

If desired, the photoreceptor may also include an overcoating. Any suitable overcoating may be utilized in the fabrication of the photoreceptor of this invention. Typical overcoatins include silicone overcoatings described, for example, in U.S. Pat. No. 4,565,760, polyamide overcoatins (e.g. Elvamide, available from E. I. du Pont de Nemours & Co.), tin oxide particles dispersed in a binder described, for example, in U.S. Pat. No. 4,426,435, metallocene compounds in a binder described, for example, in U.S. Pat. No. 4,315,980, antimony-tin particles in a binder, charge transport molecules in a continuous binder phase with charge injection particles described in U.S. Pat. No. 4,515,882, polyurethane overcoatings, and the like. The disclosures of U.S. Pat. Nos. 4,565,760, 4,426,435, 4,315,980, and 4,515,882 being incorporated herein by reference in their entirety. The choice of overcoating materials would depend upon the specific photoreceptor prepared and the protective quality and electrical performance desired. Generally, any overcoatings applied have a thickness between about 0.5 micrometer and about 10 micrometers.

After the belt has been produced it is mounted on a suitable mandrel of liner such as a collapsible mandrel for coating the photoreceptor layers. Any suitable coating materials comprising film forming polymers may be deposited on the belt from solutions, dispersions, emulsions or powders by any suitable technique. However, the deposited coating should form a thin substantially uniform fluid coating on the belt prior to solidification of the coating. Typical techniques for depositing coatings include spray coating, dip coating, wire wound rod coating, powder coating, electrostatic spraying, sonic spraying, blade coating, and the like. If the coating is applied by spraying, such spraying may be effected with or without the aid of a gas. Spraying may be assisted by mechanical and/or electrical aids such as in electrostatic spraying. Materials and process parameters are interdependent in a spray coating operation. Some of the process parameters include propellant gas pressure, solution flow rate, secondary gas nozzle pressure, gun to substrate distance, gun traversal speed and mandrel rotation rate. Materials parameters include, for example, solvent mixtures which affect drying characteristics, the concentration of dissolved solids, the composition of the dissolved solids (e.g. monomer, polymer), and the concentration of dispersed solids when dispersions or solutions are utilized. The deposited coating should be uniform, smooth, and free from blemishes such as entrained gas bubbles and the like.

Generally, when liquid carries are utilized in the coating layers, drying of each of the underlying layers is desirable prior to application of a subsequent layer. It is preferred that drying of each of the underlying layers be effected prior to the application of a subsequent coating because such drying more rapidly removes the liquid carrier and avoids the formation of blisters. The surface tension of the combination of film forming polymer material and the liquid carrier of subsequently applied coatins should preferably have a lower surface tension than the surface tension of a dried underlying coating to ensure the formation of a thin substantially uniform fluid coating on the underlying coating.

This technique may be employed for fabricating any suitable thin, free standing, seamless belt. These belts may be used for any suitable purpose such as transport belts, paper handling belts, vacuum drives, power transmission belts, optical devices, or other applications in which the presence of a seam is detrimental.

The process of this invention is also capable of preparing seamless organic photoreceptors comprising a seamless substrate, conductive ground plane and one or more photoconductive layers. The process of this invention may be used to prepare a seamless organic photoreceptor at only two stations thereby reducing handling and cleaning between deposition of various layers. This results in improvements in yield and reduces cost by minimizing sources of contamination and defects.

The invention will now be described in detail with respect to specific preferred embodiments thereof along with control examples, it being noted that these examples are intended to be illustrative only and are not intended to limit the scope of the present invention. Parts and percentages are by weight unless otherwise indicated.

The apparatus employed for the electrodeposition of the polymer films in most of the following Examples included an electrically insulating glass 1 liter container, a 8.4 cm (3.3 in.) diameter nickel belt forming sleeve mandrel electrode having a wall thickness of about 6 mils, and a 12.7 cm (0.5 in.) diameter stainless steel or graphite rod counter electrode. The length of the sleeve and rod were sufficient to extend from the bottom of the container to beyond the top of the container so that electrical connections could be made.

Dispersions of solid thermoplastic film forming polymer particles in a dispersion liquid medium were added to the container so that the total dispersion volume was about 800 ml. The polymer particles had a molecular weight greater than about 35,000, an average particle size of between about 0.01 micrometer and about 10 micrometers and were substantially insoluble in the liquid dispersion medium at electrodeposition temperatures. The electrical conductivity of the dispersions were between about $4\times10^{-8}$ mho/cm and about $1.0\times10^{-3}$ mho/cm. Unless otherwise specified, the dispersions described in the following Examples were obtained from a supplier in concentrated form. Charge control agents, conditioning additives, release agents and/or other components were added to some of the dispersions as indicated. Generally, a charge control agent was added to dispersions of some of the nonpolar polymers to ensure substantial freedom from polymer particle agglomerates having a particle size larger than twice the average particle size of the polymer particles in the dispersion. Mixing of the components and enhancement of the dispersion was accomplished by roll milling the materials in a 1 quart bottle half filled with glass beads having an average diameter of about 9 mm. Sufficient dispersion material was added to barely cover the beads.

The belt forming sleeve mandrel electrode was placed into the container and the counter electrode was placed inside the belt forming mandrel so that it was centered and coaxial therewith over its entire length. The negative side of a power supply (Model ABC 1000 Kepco available from Kepco Inc.) was connected to the belt forming mandrel electrode to create a cathode and the positive side was connected to the metal or graphite rod to create an anode.

The electrodeposition was accomplished at ambient temperature with a predetermined applied voltage for a specified time after which the belt forming sleeve mandrel electrode with the deposited coating on the inside surface was removed from the container and placed in an oven at a temperature and time that were sufficient to coalesce the particles into a uniform, viscous, sol layer and subsequently remove the solvent by evaporation. The belt on the sleeve mandrel electrode was then cooled to ambient temperature. The belt was hand peeled from the sleeve mandrel electrode to produce a free standing film.

Unless otherwise specified, these materials, procedures and equipment were used for the experiments presented in Examples I through XX described below.

EXAMPLE I

A dispersion of thermoplastic film forming polyvinyl fluoride (Type 44–1000, available from the E. I. du pont de Nemours & Co.) particles containing about 33 weight percent solids in propylene carbonate solvent was diluted with propylene carbonate to form about a 17 weight percent solids dispersion. This dispersion was placed in the container with the electrode configurations and connections as described above. The output of the power supply was set to 24 volts and the time of the applied voltage was 10 min. The oven heating was conducted at 180° C. for 5 min. with the ends of the belt forming mandrel covered and 10.0 min. with the ends open. The belt was peeled with difficulty from the belt forming mandrel after cooling to room temperature.

The thickness of the belt was about 76 μm (3 mils) and contained numerous agglomerates of PVF on the side which was not in intimate contact with the belt forming sleeve mandrel electrode surface. Some agglomerates were more than 10 times larger than the average particle size of the polyvinyl fluoride particles and extended through the thickness of the belt and caused defects on the electrode side. Although this demonstrates and electroforming belt film preparation process, the following Examples will show how the quality of the belt can be improved. Deposition of the material as supplied by the vendor yielded a poor quality film because of agglomerate particles in the dispersion and in the final belt. Since the rate of deposition diminished with time, this process is thickness limited because the thickness of the belt was not proportional to deposition time.

EXAMPLE II

A belt was prepared in the manner described in Example I except that the deposition time was 2 min. The completed belt had a thickness of 41 μm (1.6 mils). The belt was difficult to remove from the belt forming mandrel and it was covered with polymer agglomerate defects. A comparison with the process of Example I showed that the thickness of the belt is not proportional to the deposition time. A second belt was prepared with 48 volts applied between the electrodes for 3 min. This produced a belt film which had a thickness of 38.1 μm (1.5 mils) but contained many more large agglomerates as compared to a deposition voltage of 24 volts. This indicates that higher deposition voltages produces progressively poorer quality belt films due to larger agglomerates. Since bath chemistry also affects the formation of agglomerates during deposition, the voltage desired may vary depending upon the specific dispersion used.

EXAMPLE III

A belt was prepared as described in Example I except that methanol was used as a conditioning additive to produce agglomerate free belt films. Compositions of dispersions which produced agglomerate free belt films and which demonstrate a linear relationship between deposition time and film thickness are as follows.

(A) Composition:
17.2% wt. PVF at 100% solids
79.5% wt. propylene carbonate
3.29% wt. methanol (B) Composition:
17.46% wt. PVF at 100% solids
75.84% wt. propylene carbonate
6.70% wt. methanol (C) Composition:
17.8% wt. PVF at 100% solids
72.02% wt. propylene carbonate
10.2% wt. methanol The belts were formed by oven heating at 180° C. for 5 minutes with the belt forming mandrel ends covered and 20 min, with the ends open. The dispersion decribed in (A) produced agglomerate free belt films. Similar dispersions with the same composition except at a lower concentration of methanol formed belt films which had agglomerates. The dispersion described in (C) yielded agglomerate free belt films. Similar dispersions with the same composition except a higher concentration of methanol gave belt films which contained bubbles due to entrapped methanol in the film. The dispersion described in (B) produced agglomerate free belt films and the relationship between film thickness and deposition time was linear over the time range of from 1.0 to 8.0 minutes. A thickness of about 55.9 μm (2.2 mils) was obtained with a deposition time of 1 min. and 330.2 μm (13.0 mils) for a deposition time of 8.0 minutes. This established that with a PVF dispersion, using methanol as the conditioning additive, the optimum concentration range of methanol was from about 3 percent to about 10 percent by weight, based on the total weight of the dispersion mixture.

EXAMPLE IV

A dispersion was prepared as described in Example I except that acetic acid was used as a conditioning additive. The amount of acetic acid was 0.1 weight percent based on the total weight of the polyvinyl fluoride dispersion of thermoplastic film forming particles. The applied voltage was 28 volts for a period of 9 min. The oven heating time was 5 min. with the mandrel ends covered and 20 min. with the mandrel ends open. This produced an agglomerate free film which had a thickness of 63.5 μm (2.5 mils) but it could not be removed from the mandrel. This Example illustrates that some conditioning additives cause an increase in belt adhesion to metal surfaces and that a release coating ought to be applied to a mandrel prior to electrodeposition of dispersions that would otherwise adhere to the mandrel.

EXAMPLE V

A belt was prepared as described in Example I except that a fluoro surfactant (FSC, available from the E. I. du pont de Nemours & Co.) was used as a conditioning additive. The amount of FSC was 0.125 weight percent based on the total weight of the dispersion and this corresponds to 0.75 weight percent of the thermoplastic film forming particle solids. The applied voltage was 24 volts and the time was 3 min. This gave agglomerate free belt films which in addition, had a greater thickness. A film made with no FSC had a thicknesses of 48.26 μm (1.9 mils) versus 96.5 μm (3.8 mils) with FSC which is a factor of about 2×increase in thickness. Using the same voltage and deposition time, films prepared with 0.25 weight percent of FSC based on the total weight of the solids and 0.042 weight percent based on the total weight of the dispersion were free of agglomerates and had a thickness of about 88.26 μm (3.47 mils) which indicated that lower levels of FSC leads to thinner belt films. A factor of 3×increase in the FSC concentration, 0.042 vs 0.125 weight percent gives a factor of only 1.085×increase in film thickness (96.5 μm vs 88.3 μm). The belt films were clear and of good quality. Also, they were more easily removed from the mandrel as compared to Examples I through III.

EXAMPLE VI

A belt was prepared as descibed in Example I except that the belt forming mandrel electrode was a seamless nickel sleeve which had a diameter of 26.97 cm (10.62 in.). The thermoplastic film forming polymer dispersion contained 9.45 weight percent of polyvinyl fluoride resin, 86 weight percent of propylene carbonate solvent and 4.5 weight percent of methanol as the conditioning additive. The deposition voltage was 40 volts and it was applied for a deposition time of 2 min. The oven heating was at 170° C. for 5 min. with the belt forming mandrel end covered and 10 min. with the belt forming mandrel end open. The thickness of the belt film after removal from the mandrel was 31.75 μm (1.25 mils). This demonstrates that larger size belt films can be prepared by using larger diameter belt forming mandrel electrodes.

EXAMPLE VII

A belt was prepared as described in Example VI except that a release coating consisting of silicone resin (F-544, available from Wacker Chemical Co. of Adrian, Mich.) with an amine curing agent (F-546 from Wacker Chemical Co.) was applied to the inside surface of the belt forming sleeve mandrel electrode. This release coating is reusable and can be used for the preparation of many belt films. The electrodeposition dispersion consisted of 9.4 weight percent of polyvinyl fluoride resin, 86 weight percent of propylene carbonate solvent and 4.5 weight percent of methanol as a conditioning additive. The deposition was accomplished with an applied voltage of 30 volts and a deposition time of 9 min. The oven heating was for 5 min. with the mandrel ends covered and 5 min. with the ends open. The belt film was completely self releasing after trimming of the edges and had a thickness of 76.2 μm (3 mils). This demonstrates a reusable release coating that factilitates self releasing of the belt film after cooling to room temperature.

Other non-reusable release coatings which were demonstrated to produce acceptable self release of the belt film the belt film forming mandrel were Frekote 33, 44 and 700 from Frekote Inc. of Boca Raton, Fla., Dow 20 Silicone release fluid from the Dow Chemical Co. of Midland, Mich. and E-155 from Wacker Chemical Co. These materials which are suitable for one at a time belt preparation were applied to the inside surface of the sleeve mandrel and oven dried as recommended by the manufacturer prior to use in the electrodeposition process. The thermoplastic film forming particle dispersion consisting of 17.5 weight percent polyvinyl fluoride resin, 72.2 weight percent to propylene carbonate solvent and 7.5 weight percent of methanol conditioning additive. The deposition potentials which gave acceptable film thickness were in the range of 30 to 80 volts and the oven drying was accomplished at 180° C. for 5 min with the belt forming mandrel ends covered and 15 min. with the ends open to evaporate the solvent. Belts, each having a thickness of about 76.2 micrometers, were obtained for each of the release coatings except that the release coatings were reapplied for each belt fabricated.

EXAMPLE VIII

A deposition was accomplished using a container configuration described in Example I except that the anode and cathode were flat aluminum electrodes with a width of 0.75 in. and thickness of about 6 mils. The electrodes extended from the bottom to beyond the top of the container for electrical connections. The thermoplastic film forming dispersion consisted of polycarbonayte resin powder (Merlon M-39, available from Mobay Chemical Co.) dispersed in a carrier liquid mixture of a 1:1 volume ratio of methyl ethyl ketone and methylene chloride solvents. The dispersion consisted of 3.57 percent weight of polycarbonate resin and 96.43 percent weight of the carrier liquid. The deposition was conducted with an applied voltage of 900 volts for a period of 5 min. The deposited material on the electrode was about 127 micrometers (5 mils) in thickness. This demonstrates that the polycarbonate powder electrodeposits.

EXAMPLE IX

A deposition was accomplished as described in Example VIII except that the thermoplastic film forming polymer particles consisted of 33.2 weight percent of clear polyurethane powder coating (VEDOC VP-180, available from Ferro Corp. of Cleveland, Ohio), 66.4 weight percent of n-heptane solvent as the carrier liquid and 0.33 weight percent of anionic surfactant (FC-120 Fluorad, available from the 3M Company of St. Paul, Minn.) as the conditioning additive. The deposition was conducted for 10 min. followed by oven heating at 180° C. for 2 min. Deposition occurred on the anode and the deposited film was about 20 μm in thickness. This demonstrates that the polyurethane powder electrodeposits.

EXAMPLE X

A belt was prepared as described in Example VI except that the thermoplastic film forming polymer dispersion consisted of 24.85 weight percent of polyvinylidene fluoride (Kynar 8VDF TYPE 202, available from Pennwalt Corp. of Philadelphia, Pa.) and 70.7 weight percent of propylene carbonate solvent. The Kynar 202 contains 4.4 weight percent mica as a filler. The deposition was conducted at 90 volts for 10 min. followed by oven heating at 270° C. for 10 min. with the belt film forming mandrel ends covered and for 10 min. with the ends open. The belt film was removed from the belt forming mandrel electrode by immersion in deionized water for about 20 min. The thickness of the belt film after removal from the mandrel electrode was 72.37 μm (2.85 mils). The belt was white in color due to the mica filler and of good quality.

EXAMPLE XI

A belt was prepared as described in Example I except that the thermoplastic film forming polymer dispersion consisted of 16.37 weight percent of polyvinylidene fluoride (Kynar 7201, available from Pennwalt Corp. of Philadelphia Pa.) and 83.63 weight percent of propylene carbonate solvent. The deposition was conducted at a voltage of 90 volts for a period of 20 min. The oven heating was at 180° C. for 1 min. with the belt forming mandrel ends covered and for 10 min. with the ends open. The film was removed from the belt forming mandrel. The belt had a thickness of 63.5 μm (2.5 mils) with good transparency and fair surface quality.

EXAMPLE XII

A belt was prepared as described in Example I except that the thermoplastic film forming polymer dispersion consisted of 4.9 weight percent polyvinyl fluoride resin, 94.8 weight percent of propylene carbonate solvent and 0.306 weight percent of vanadyl phthalocyanine pigment. The deposition was conducted at a voltage of 24 volts and time of 3 min. The oven heating was at 180° C. for a period 5 min. with the belt forming mandrel ends covered and for 10 min. with the ends open. The thickness of the film after removal from the film forming mandrel was 88.9 μm (3.5 mils). This demonstrates that a phthalocyanine type pigment can be co-electrodeposited as a filler material within the belt film.

EXAMPLE XIII

A belt was prepared as described in Example I except that the dispersion consisted of a roll milled mixture of 16.3 weight percent of polyvinyl fluoride resin, 80.4 weight percent of propylene carbonate solvent and 3.3 weight percent of Wollastonite 200 reinforcing filler available from Pfizer Inc. The deposition was conducted at a voltage of 24 volts for 3 min. and oven heated at 180° C. for 5 min. with the film forming mandrel ends covered and for 10 min. with the ends open. The belt film after removal from the belt forming mandrel had a thickness of 127 μm (5 mils). The film was opaque and the surface quality was good. Analytically based gravimetric analysis indicated that the film had a nearly proportional loading of Wollastonite 200, thus co-deposition with polyvinyl fluoride occurs. Other fillers which have also been demonstrated to give similar results include Astroquartz #556 Fiber, Wollastonite 325, 400 Wollastokup 10014, 10 Wollastokup 110014, all available from Pfizer Inc., barium titanate from Ferro Corp. of Penn Yan N.Y., tin oxide from Suaerlite Inc. and antimony tin oxide from Magnesium Elektron Inc. of Flemington N.J.

EXAMPLE XIV

A belt was prepared in the manner described in Example I except that the thermoplastic film forming polymer dispersion used for the deposition consisted of 11.7 weight percent of PVF resin, 87.3 weight percent of propylene carbonate carrier liquid, 1.0 weight percent of carbon black and 0.75 weight percent of FC-135 fluoro surfactant. The oven heating was at 180° C. for 30 min. with the film forming mandrel open only. The belt film after removal from the mandrel had a thickness of 63.5 μm (2.5 mils) and it was black throughout and on the outside surfaces with good surface quality. The surface resistivity of the coating was about $10^6$ ohm-cm.

EXAMPLE XV

A belt was prepared as described in Example XIV except that the thermoplastic film forming polymer dispersion consisted of 16.26 weight percent of polyvinyl fluoride resin, 82.3 weight percent of propylene carbonate solvent and 1.41 weight percent of carbon black. The conditioning additive was 0.75 weight percent of surfactant (FC-135 fluoro). The deposition was conducted at 24 volts for 3 min. The coated mandrel was then oven heated at 180° C. for 30 min. with no cover on the film forming mandrel ends. The belt film after removal from the mandrel had a thickness of 124.5 μm (4.9 mils) and had good surface quality with uniform thickness. The deposition was conducted at a higher solids loading as compared to Example XIV and the factor increase in thickness was 1.96× for a percent weight increase in resin of from 11.69 to 16.26, which is a factor of 1.39×. This demonstrates that higher solids of the thermoplastic film forming dispersion with carbon black gives thicker belt films.

EXAMPLE XVI

A belt was prepared as described in Example III except that the belt forming mandrel had a diameter of 12.065 cm (4.75 in.). Also, a dispersion consisting of 6.5 weight percent of resin solid, 91.9 weight percent of propylene carbonate solvent and 1.3 weight percent of Black Pearls 2000 carbon black was applied as a coating to the inside surface of the belt forming mandrel by brush application prior to the electrodeposition step. This coating was oven heated at 180° C. for 5 min. with the mandrel ends covered and for 10 min. with the ends open to form a conductive surface which would eventually be located on the outside of the electrodeposited belt. The belt forming mandrel was then immersed in a dispersion of the thermoplastic film forming PVF particles identical to composition (B) described in Example III. The deposition was conducted at a voltage of 24 volts and time of 3 min. After electrodeposition, the deposited PVF coating was oven heated at 180° C. for 5 min. while the mandrel ends were covered and for 10 min. with the ends open. The final belt had a thickness of 76.2 μm (3.0 mils) that adhered well to the carbon black loaded coating. The removed belt was black on the outside surface and had a surface resistivity of less than about 10,000 ohms/square. This demonstrates that a thick polyvinyl fluoride belt film can be prepared with a thin conductive outer surface layer.

EXAMPLE XVII

A belt was prepared as described in Example III with dispersion composition (B) except that the mandrel had a diameter of 12.065 cm (4.75 in.). The deposition was conducted at a voltage of 24 volts and time of 3 min. After coalescence and cooling to room temperature a polyvinyl fluoride with carbon black dispersion was applied by brush application to the inside surface of the electrodeposited film. The carbon black loaded dispersion had the same composition as that used in Example XVI. This inner coating was coalesced at 180° C. for 5 min. with the mandrel ends covered and 10 min. with the ends open. The total thickness after removal from the mandrel was 133.4 μm (5.25 mils). This demonstrates that a belt film can be prepared with a thin conductive layer on the inside surface of the belt and that the conductive layer adheres well to the carbon black free layer.

EXAMPLE XVIII

A belt was prepared as described in Example VI except that a screen of light wire aluminum cloth having a thickness of 12 mils was placed in contact with the inside of the belt forming sleeve mandrel prior to and during deposition of the thermoplastic film forming particles. The dispersion employed consisted of 15.06 weight percent of polyvinyl fluoride, 84.94 weight percent of propylene carbonate and 0.75 weight percent of fluoro surfactant (FC-135). The deposition time was 13 min. The film forming mandrel was oven heated for 5 min. with the ends covered and for 10 min. with the ends open. The thickness of the belt in the non screened reinforced areas was 76 μm (3.0 mils). In general, the thickness of the screen which was 304.8 μm (12 mils) dominated the overall thickness of the reinforced belt, but this demonstrates the principle of reinforcement of the belt with an internal filament like material. Other reinforcing screen materials such as stainless steel gave similar results.

EXAMPLE XIX

A belt was prepared as described in Example I except that the dispersion employed consisted of 25 weight percent of polyvinyl fluoride resin solids and 75 weight percent of propylene carbonate solvent. A deposition time of 3 min. produced a belt film having a thickness of 96.5 μm (3.8 mils). An electrodeposited belt previously prepared from a dispersion containing 16.9 weight percent of polyvinyl fluoride resin solids using a deposition time of 3 min. produced a belt film having a thickness of 48.4 μm (1.9 mils). The factor increase in the solids was 1.48× and this gave about a 2.0× increase in belt film thickness. This demonstrates dependence of film thickness on the solids concentration for a constant deposition time.

EXAMPLE XX

A belt was prepared as described in Example VI except that after removal from the mandrel it was used as a substrate for a photoreceptor consisting of organic materials which were spray coated onto the outside surface of the belt. The ground plane coating consisted of about 15 weight percent carbon black dispersed in an acrylic polymer (68080 from the E. I. du Pont de Nemours & Co.), the 1 μm thick electrical blocking layer was polyamide resin (Macromelt 6300, available from Henkle Co.), the 2 μm thick generator layer contained 30 percent by weight of trigonal selenium in polyvinyl carbazole polymer binder and the 20 μm thick charge transport layer contained 40 percent by weight N,N'-bis(methylphenyl)-[1,1'-biphenyl]-4,4'-diamine in polycarbonate resin (Merlon M-39, available from Mobay Co.). The completed photoreceptor device exhibited good electrophotographic cycling characteristics.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrodeposition process for forming a free standing belt shaped film comprising providing at least one sleeve electrode coaxially spaced apart from and surrounding at least one other electrode in a bath comprising a dispersion of electrically charged, thermoplastic film forming polymer particles in an organic liquid dispersion medium substantially free of water, said polymer particles having a weight average molecular weight of at least about 35,000 and being substantially insoluble in said organic dispersion liquid medium at electrodeposition temperatures and sufficiently soluble in said organic dispersion liquid medium at elevated drying temperatures to coalesce and form a viscous coating, applying an electric field across the electrodes until a thick, substantially uniform deposit of polymer particles forms on the interior surface of said sleeve electrode, removing said sleeve electrode bearing said deposit of polymer particles and residual liquid dispersion medium clinging to said deposit of polymer particles from said bath, heating said deposit to initially solubilize said polymer particles in said residual organic liquid dispersion medium to form a coalesced, continuous viscous coating of the solublized polymer particles, continuing said heating to evaporate said residual organic liquid dispersion medium and form a continuous, solidified, dry, belt shaped polymer film, cooling said continuous, solidified, dry, belt shaped polymer film, and removing said continuous, solidified, dry, belt shaped polymer film from said interior surface of said sleeve electrode.

2. An electrodeposition process according to claim 1 wherein said thermoplastic film forming polymer particles in said organic liquid dispersion medium have an average particle size of between about 0.01 micrometer and about 10 micrometers and wherein said dispersion is substantially free of polymer particle agglomerates.

3. An electrodeposition process according to claim 1 wherein the concentration of said polymer particles in said dispersion is between about 0.5 percent by weight and about 60 percent by weight based on the total weight of said dispersion.

4. An electrodeposition process according to claim 1 wherein the solubility of said polymer particles in said dispersion medium is greater than about 1 percent by weight based on the weight of said deposit of particles at temperatures employed during said heating.

5. An electrodeposition process according to claim 1 wherein said coalesced, continuous viscous coating of the solublized polymer particles is a sol.

6. An electrodeposition process according to claim 1 wherein said interior surface of said sleeve electrode is precoated with a thin coating of release material.

7. An electrodeposition process according to claim 1 wherein said dispersion also comprises up to about 10 percent by weight surfactant based on the total weight of dispersion solids.

8. An electrodeposition process according to claim 1 wherein said dispersion also comprises up to about 10 percent by weight release material based on the total weight of dispersion solids.

9. An electrodeposition process according to claim 1 wherein said dispersion also comprises up to about 10 percent by weight of a charge control agent based on the total weight of dispersion solids.

10. An electrodeposition process according to claim 1 wherein said polymer particles also contain up to about 50 percent by weight filler particles based on the total weight of the polymer particles and filler particles.

11. An electrodeposition process according to claim 1 wherein said dispersion medium contains less than about 10 percent water based on the total weight of said liquid dispersion medium.

12. An electrodeposition process according to claim 1 wherein said dispersion has an electrical conductivity between about $4\times10^{-8}$ mho-cm and about $1\times10^{-3}$ mho/cm.

13. An electrodeposition process according to claim 1 wherein said interior surface of said sleeve electrode has a critical surface tension of less than about 31 dynes/cm and an electrical conductivity of at least about $1\times10^{-5}$ mho/cm.

14. An electrodeposition process according to claim 1 wherein said organic liquid has a boiling point higher than the temperature employed for electrodeposition.

15. An electrodeposition process according to claim 1 wherein said continuous, solidified, dry, belt shaped polymer film contains less than about 5 percent by weight of said organic liquid dispersion medium based on the total weight of said continuous, solidified, dry, belt shaped polymer film.

16. An electrodeposition process according to claim 1 wherein said continuous, solidified, dry, belt shaped polymer film has a thickness between about 5 micrometers and about 500 micrometers.

17. An electrodeposition process according to claim 1 wherein said dispersion also comprises a second organic liquid comprising an alcohol containing from 1 to 3 carbon atoms.

18. An electrodeposition process according to claim 1 wherein said cooling of said continuous, solidified, dry, belt shaped polymer film comprises rapid quenching of the coated electrode by immersion in a liquid bath.

19. An electrodeposition process for forming a free standing belt shaped film comprising providing at least one sleeve electrode, forming a thin electrically conductive layer on the interior surface of said sleeve electrode, submerging said sleeve electrode and thin electrically conductive layer into a bath with said sleeve electrode being coaxially spaced apart from and surrounding at least one other electrode in said bath, said bath comprising a dispersion of electrically charged, thermoplastic film forming polymer particles in an organic liquid dispersion medium substantially free of water, said polymer particles having a weight average molecular weight of at least about 35,000 and being substantially insoluble in said organic dispersion liquid medium at electrodeposition temperatures and sufficiently soluble in said organic dispersion liquid medium at elevated drying temperatures to coalesce and form a viscous coating, applying an electric field across the electrodes until a thick, substantially uniform deposit of polymer particles forms on said thin electrically conductive layer on said interior surface of said sleeve electrode, removing said sleeve electrode bearing said electrically conductive layer and said deposit of polymer particles and residual liquid dispersion medium clinging to said deposit of polymer particles from said bath, heating said deposit to initially solubilize said polymer particles in said residual organic liquid dispersion medium to form a coalesced, continuous viscous coating of the solubilized polymer particles, continuing said heating to evaporate said residual organic liquid dispersion medium and form a continuous, solidified, dry, belt shaped polymer film on said electrically conductive layer, and removing said electrically conductive layer and continuous, solidified, dry, belt shaped polymer film from said interior surface of said sleeve electrode.

20. An electrodeposition process for forming a free standing belt shaped film comprising providing at least one sleeve electrode coaxially spaced apart from and surrounding at least one other electrode in a bath comprising a dispersion of electrically charged, thermoplastic film forming polymer particles in an organic liquid dispersion medium substantially free of water, said polymer particles having a weight average molecular weight of at least about 35,000 and being substantially insoluble in said organic dispersion liquid medium at electrodeposition temperatures and sufficiently soluble in said organic dispersion liquid medium at elevated drying temperatures to coalesce and form a viscous coating, applying an electric field across the electrodes until a thick, substantially uniform deposit of polymer particles forms on the interior surface of said sleeve electrode, removing said sleeve electrode bearing said deposit of polymer particles and residual liquid dispersion medium clinging to said deposit of polymer particles from said bath, heating said deposit to initially solubilize said polymer particles in said residual organic liquid dispersion medium to form a coalesced, continuous viscous coating of the solublized polymer particles, continuing said heating to evaporate said residual organic liquid dispersion medium and form a continuous, solidified, dry, belt shaped polymer film, removing said continuous, solidified, dry, belt shaped polymer film from said interior surface of said sleeve electrode, applying an electrically conductive layer on said film, applying a charge generation layer, and applying a charge transport layer.

* * * * *